US011653735B2

(12) United States Patent
Sze

(10) Patent No.: US 11,653,735 B2
(45) Date of Patent: May 23, 2023

(54) HAIR FASTENER

(71) Applicant: Tung Hing Plastic Manufactory Ltd., Hong Kong (CN)

(72) Inventor: Ka Chuen Sze, Hong Kong (CN)

(73) Assignee: Tung Hing Plastic Manufactory Limited, Hong Kong (HK)

( * ) Notice: Subject to any disclaimer, the term of this patent is extended or adjusted under 35 U.S.C. 154(b) by 524 days.

(21) Appl. No.: 16/680,496

(22) Filed: Nov. 12, 2019

(65) Prior Publication Data

US 2020/0163430 A1 May 28, 2020

(30) Foreign Application Priority Data

Nov. 26, 2018 (AU) ..... 2018271255

(51) Int. Cl.
*A45D 8/20* (2006.01)

(52) U.S. Cl.
CPC ..... *A45D 8/20* (2013.01)

(58) Field of Classification Search
CPC ..... A45D 8/20; A45D 6/145; A45D 2/42
See application file for complete search history.

(56) References Cited

U.S. PATENT DOCUMENTS 2,459,926 A * 1/1949 D Alberto ..... A45D 8/20 132/277
3,250,282 A * 5/1966 Thatcher ..... A45D 8/20 132/277
3,860,014 A * 1/1975 Clifton ..... A45D 8/34 132/278
5,697,388 A * 12/1997 Chang ..... A45D 8/20 132/277
6,047,705 A * 4/2000 Hawley ..... A45D 8/12 132/275
7,278,432 B2 * 10/2007 Lane ..... A41G 5/004 132/53
8,474,465 B2 * 7/2013 Daley ..... A45D 2/42 132/211
2006/0124149 A1 * 6/2006 Salisbury ..... A45D 8/20 132/277
2007/0131238 A1 * 6/2007 Chudzik ..... A45D 8/20 132/277
2009/0255553 A1 * 10/2009 Hsu ..... A45D 8/20 132/277

(Continued)

FOREIGN PATENT DOCUMENTS

EP 1046354 A1 10/2000

*Primary Examiner* — Nicholas D Lucchesi
*Assistant Examiner* — Jennifer Gill
(74) *Attorney, Agent, or Firm* — Melvin Li

(57) ABSTRACT

There is provided a hair fastener in the form of a hair claw. The hair fastener has a first claw member, a second claw member and an elongate block. Each of the first and second claws is provided with a front portion, a rear portion and a joint portion arranged in between, the rear portions of the first and second claw members acting as a pair of handles for controlling opening or closure of the hair fastener. In one embodiment, the front region of the elongate block includes a plurality of tension cables, and a clearance is provided between the tension cables and the rear region such that the tension cables and the rear region can operate independently of each other.

6 Claims, 13 Drawing Sheets

(56) References Cited

U.S. PATENT DOCUMENTS

| | | | | |
|---|---|---|---|---|
| 2010/0139687 | A1* | 6/2010 | Hsu | A45D 8/20<br>132/277 |
| 2017/0215542 | A1 | 8/2017 | Han | |
| 2017/0258193 | A1* | 9/2017 | Leo | A45D 8/16 |

* cited by examiner

HAIR FASTENER

CROSS REFERENCE TO RELATED APPLICATION

The present application claims priority from earlier filed Australian Patent Application No. 2018271255 filed Nov. 26, 2018, contents of which are incorporated herein in their entirety.

FIELD OF THE INVENTION

The present invention is concerned with a hair fastener in the form of a hair claw with an enhanced hair securing behavior, and a method of manufacture thereof.

BACKGROUND OF THE INVENTION

There are a variety of hair accessories for meeting the different needs of managing hair of a user. For example, there are hair fasteners in the form of a hair barrette often used to secure a layer of hair. Another particular type of hair fasteners is in the form of a hair claw. However, one drawback of some hair claws (or in fact some other hair fasteners) in the market is that hair secured thereby often get caught by different moving parts thereof thus causing damage to hair and pain to the user. Other drawbacks of some hair fasteners are that they are difficult to manufacture and/or they are not durable such that after a short period of time of repeated use they tend to lose their capability of securing hair tightly or would even fall apart. Yet another drawback is that some conventional hair fasteners are difficult to operate. For example, some hair claws in the market may be too stiff to operate and require much force from the user to depress handles controlling the opening or closure during use.

The present invention seeks to address the problems discussed above, or at least provide an alternative to the public.

SUMMARY OF THE INVENTION

According to a first aspect of the present invention, there is provide a hair fastener in the form of a hair claw comprising a first claw member, a second claw member and an elongate block, wherein:

each of the first and second claws is provided with a front portion, a rear portion and a joint portion arranged in between, the rear portions of the first and second claw members acting as a pair of handles for controlling opening or closure of the hair fastener, the elongate block is positioned between the first and second claw members at the joint portions thus acting as a hinge at which the first and second claw members are pivotably and reciprocatingly movable with respect to each other, the elongate block is made of essentially polymeric materials and provided with a front region and a rear region connected by remaining regions of the elongate block, the front region includes a plurality of tension cables, and a clearance is provided between the tension cables and the rear region such that the tension cables and the rear region can operate independently of each other, and the elongate member is adapted to assume a first configuration in which as the handles are moved towards each other the rear region is compressed and the tension cables are stretched, and a second configuration in which as the handles are released the tension cables pull the first and second claw members towards each other thus returning the hair fastener to a closed or default state.

Preferably, each of the joint portions of the claw members may be provided with an opening defining a rim, and the elongate block may be provided with an upper circumferential groove and a lower circumferential groove formed at opposite ends thereof, or an upper end and a lower end thereof, and the elongate block fixedly may connect to the first and second claw members with the grooves engaged to the rims.

In an embodiment, the opposite ends of the elongate block may protrude through the joint portions.

In one embodiment, the elongate block may include a center piece, a top piece and a bottom piece, with the top piece and the center piece together defining the upper circumferential groove and the bottom piece and the center piece together defining the lower circumferential groove, and wherein the top piece and the bottom piece are fixedly connected to the center piece thus sandwiching and securing the first and second claw members together at the center piece.

Advantageously, the openings of the joint portions may generally be of oval shape, with the grooves sized and shaped to complementarily engage with the rims and the elongate block configured generally in the form of an oval-shaped connector. The elongate block may generally be in the form of or resembling an egg-shaped connector acting as a hinge for the first and second claw members.

Preferably, the first and second claw members may be made of a material selected from the group consisting of ABS, PP, HIPS, GPPS, PE, Nylon, polycarbonate, K-resin, acetal, cellulose acetate, PVC, PET and PLA, and the elongate block may comprise or may be made essentially of silicone. With these material characteristics, the chance that hair to be tied would get caught by moving or metallic parts of the hair fastener would be minimized if not totally avoided.

Suitably, the hair fastener may comprise four such tension cables arranged and spaced evenly across the front region of the elongate block.

In preferred embodiments, the hair fastener or at least the hinge thereof may be free of any metallic components.

According to a second aspect of the present invention, there is provided a hair fastener in the form of a hair claw comprising a first claw member, a second claw member and an elongate block, wherein:

each of the first and second claw members is provided with a front portion, a rear portion and a joint portion arranged in between, the rear portions of the first and second claw members acting as a pair of handles for controlling opening or closure of the hair fastener, the elongate block is made of a top piece, a center piece and a lower piece, with the center piece positioned between the first and second claw members at the joint portions thus acting as a hinge at which the first claw members are pivotably and reciprocatingly movable with respect to each other, the top piece and the bottom piece are fixedly connected to the center piece via the first and second claw members thus sandwiching and securing the first and second claw members together at the center piece, the elongate block is made of essentially polymeric materials, and the elongate member is adapted to assume a first configuration in which as the handles are moved towards each other a rear region of the center piece is compressed and a front region of the center piece is stretched, and a second configuration in which as the handles are released the front region of the center piece pulls the claw members towards each other thus returning the hair fastener to a closed or default state.

Such configuration of the elongate block protruding through the opening is significant at least in a two-fold manner. First, the area of contact between the elongate portion and the claw members is not limited to a surface of the elongate block and an inwardly facing surface of the claw members. Instead, the area of contact (and connection) is spread across the length or area of the rims and the grooves of the elongate blocks. This is significant in that it can minimize excessive tension and difficulty in spreading apart the handles during use. Yet, the connection between the elongate block and the claw members at the rims and grooves is enhanced in terms of durability. Second, with the protrusion the elongate block can be made with an enlarged volume which can withstand reciprocating pressure and stretching arising from a repeated operation of closure or opening of the claw members.

According to a third aspect of the present invention, there is provided a method of manufacture of a hair fastener as described above, wherein the method comprises a step of connecting the elongate block, or the top, bottom and center pieces, to the first and second claw members by heat sealing or by adhesives.

According to a fourth aspect of the present invention, there is provided a method of manufacture of a hair fastener, comprising steps of:

forming a first claw member and a second claw member, forming a hinge to an elongate block made of essentially polymeric materials only by injection molding, the elongate block including a front region and a rear region connected together by remaining regions of the elongate block, the front region in the form of a plurality of tension cables, wherein a clearance is provided between the tension cables and the rear region of the elongate block, and positioning the elongate block between the pair of claw members at joint portions thereof and fixedly connecting the elongate block to the hair fastener at the joint portions.

Preferably, the method may comprise steps of forming an opening at the joint portions of each of the first and second claw members, forming a pair of grooves on opposite ends, or an upper end and a lower end, of the elongate block, and fixedly connecting the elongate block to the first and second claw members with the grooves engaged to the rims.

Suitably, the method may comprise a step of connecting the elongate block to the first and second claw members such that opposite ends of the elongate block protrude through the openings at the joint portions.

In one embodiment, the elongate block may include a top piece, a center piece and a bottom piece with the top piece and the bottom piece sandwiching the claw members at the joint portions and connected to the center piece thus securing the elongate block is place in the hair fastener.

In preferred embodiments, the hair fastener or at least the hinge thereof may be free of any metallic components.

Suitably, the joint portions may be provided with openings at which the elongate block engages. In a preferred embodiment, the elongate block may generally be in the form of an oval-shaped connector.

The first and second claws may be made of a material selected from the group consisting of ABS, PP, HIPS, GPPS, PE, Nylon, polycarbonate, K-resin, acetal, cellulose acetate, PVC, PET and PLA, and the elongate block may comprise or may be made essentially of silicone.

In a preferred embodiment, there may be provided with four such tension cables arranged and spaced evenly at the front portion of the elongate block.

BRIEF DESCRIPTION OF DRAWINGS

Some embodiments of the present invention will now be explained, with reference to the accompanied drawings, in which:

FIG. 12 is a schematic view showing an interior structure of a connector of the hair fastener of FIG. 1;

DETAILED DESCRIPTION OF PREFERRED EMBODIMENTS OF THE INVENTION

The present invention is concerned with hair fastening devices, and is illustrated and explained by way of examples below.

Figure 1:
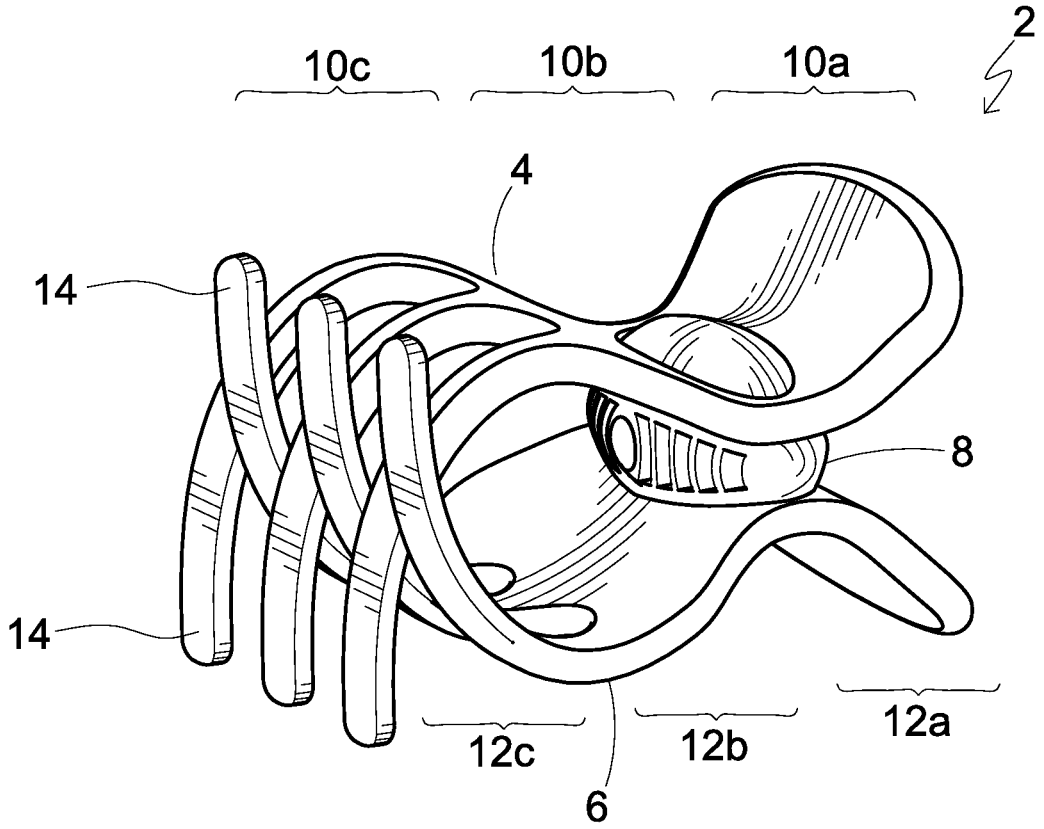
FIG. 1 and FIG. 2 are two different perspective views illustrating a first embodiment of a hair fastener according to the present invention.
Figure 2:
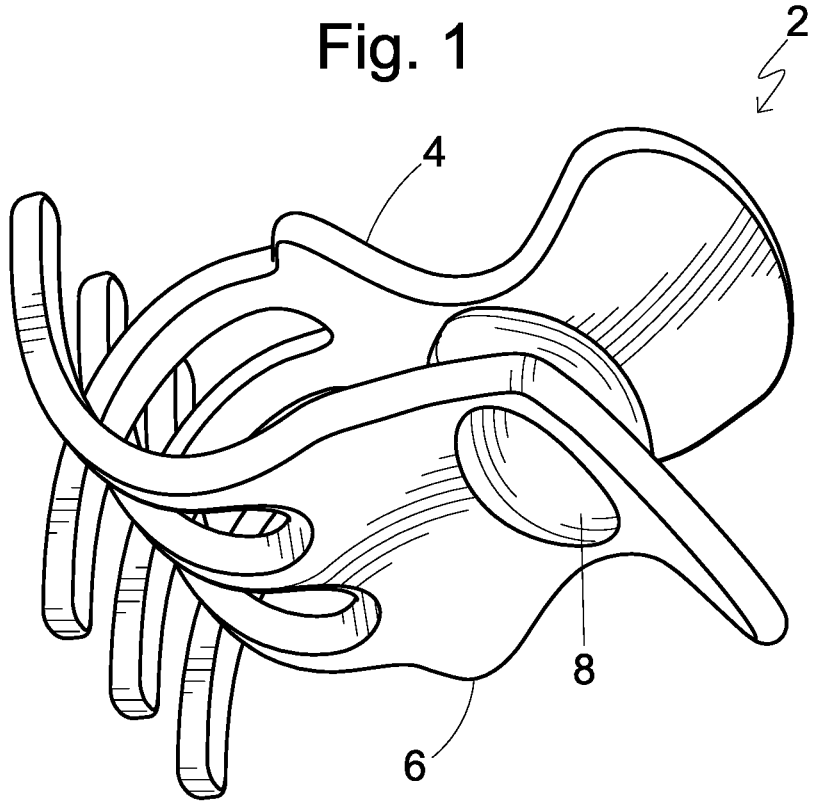

A first embodiment of a hair fastener according to the present invention, generally designated 2, is illustrated in FIGS. 1 to 11. FIG. 1, for example, shows that the hair fastener 2 has an upper claw member 4, a lower claw member 6 and a connector 8. (It is to be noted that references of "upper" and "lower", "rear" and "front", "upwardly facing" and "downwardly facing", "right" and "left", etc. in this specification refers to relative locations in the hair fastener and does not restrict the meaning with the hair fastener having to be oriented in a particular position.) FIG. 1 and FIG. 2 show that the hair fastener 2 has assumed a closed, or default, configuration.

The upper claw member 4, or a first claw member, has a rear portion 10*a*, a joint portion 10*b* (or middle portion) and a front portion 10*c*. The lower claw member 6, or a second claw member, likewise has a rear portion 12*a*, a joint portion 12*b* (or middle portion) and a front portion 12*c*. The upper and lower claw members 4, 6 are connected together at the joint portions 10*b*, 12*b* by the connector 8. In this embodiment, each of the claw members 4, 6 has three fingers 14 extending from the rear to the front thereof. FIG. 1 and FIG. 2 show that in a default configuration the claw members 4, 6 are closed against each other with the fingers 14 arranged complementarily and in an interlocking arrangement.

Figure 3:
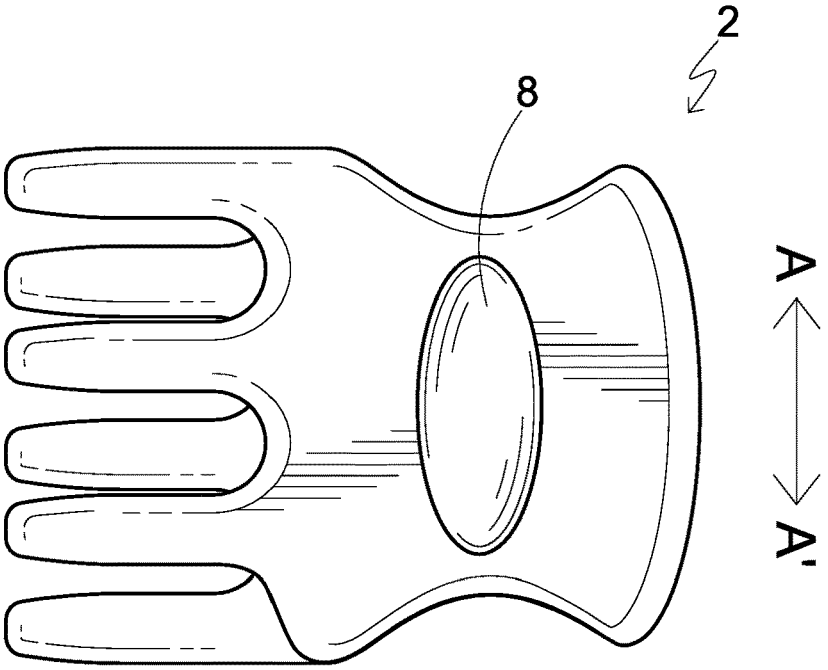
FIG. 3 and FIG. 4 are top and bottom views of the hair fastener of FIG. 1.
Figure 4:
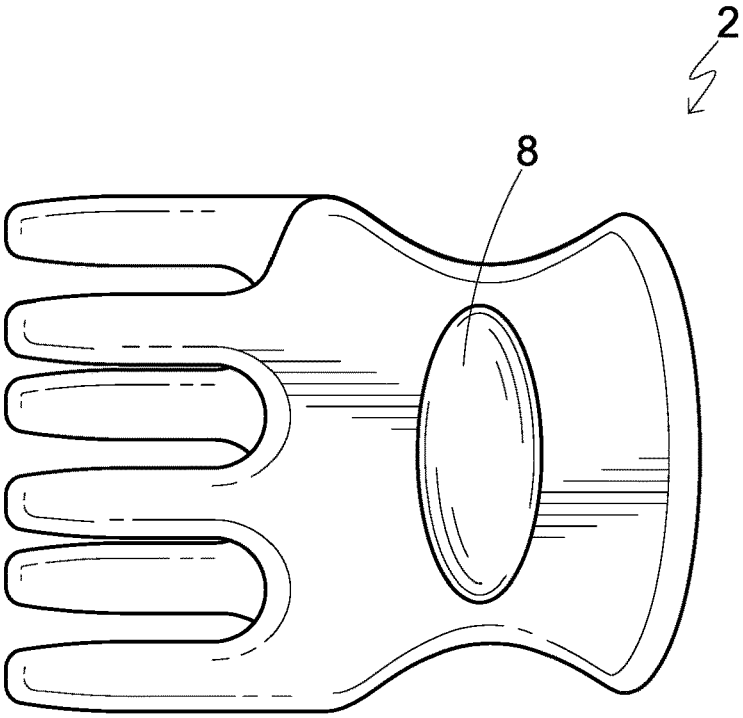

FIGS. 1 to 6 also show that the connector 8 has an elongate or elliptical profile and extends laterally across the joint portions of the claw members 4, 6 as indicated by the arrow A<------>A' in FIG. 3.

FIGS. 1, 2, 5, 6 and 11 show that the joint portions 10*b*, 12*b* of the claw members 4, 6 have an elongate oval-shaped opening 16*a*, 16*b* defined by a pair of rims 18*a*, 18*b* formed on the claw members 4, 6. As demonstrated in the figures, the connector 8, in the form of an elongate block, is provided with a circumferential groove 20*a*, 20*b* on opposite sides (upwardly facing and downwardly facing sides) thereof. The rims 18*a*, 18*b* from the claw members 4, 6 and the grooves 20*a*, 20*b* from the elongate block 8 are sized and shaped such that the grooves 20*a*, 20*b* fit complementarily to the rims 18*a*, 18*b*, respectively. Oppositely disposed parts of the elongate block 8 protrude from the claw members 4, 6 at the joint portions 10*b*, 12*b* through the openings 16*a*, 16*b*. In other words, the elongate block is essentially visible from all six orthogonal views of the hair fastener 2. In particular, the protruded portion of the connector 8 is visible when the hair fastener 2 is viewed from above or below. Please see for example FIGS. 1-6 and FIG. 10.

The upper and lower claw members 4, 6 (or the right and left claw members depending how the hair fastener is oriented) are preferably made of a material selected from the group consisting of ABS, PP, HIPS, GPPS, PE, nylon, polycarbonate, K-resin, acetyl, cellulose acetate, PVC, PET and PLA. The elongate block 8 may comprise or is essentially made of silicone. This particular combination of these material candidates can provide a balance of desired physical characteristics of contact comfort, structural durability and visual aestheticism. Due to the hair fastener 2 made essentially of polymeric materials and free of any metallic components, the chance that hair to be tied would get caught by moving or metallic parts, e.g. metallic or spring hinges, is minimized if not totally avoided.

Figure 9:
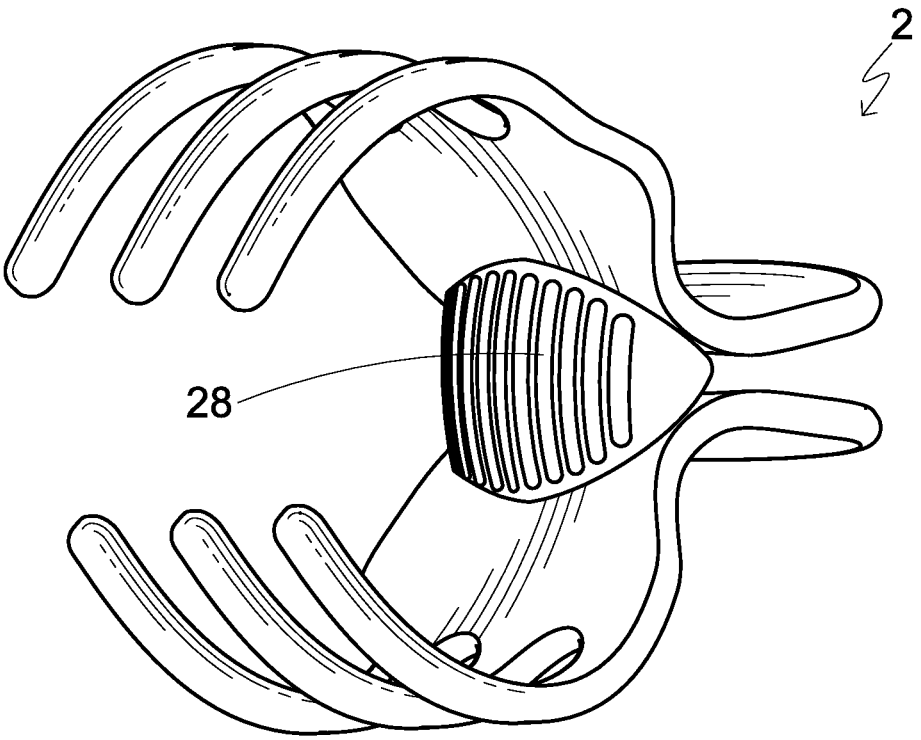
FIG. 9 and FIG. 10 are two different perspective views of the hair fastener of FIG. 1, but assuming an open or expanded configuration.
Figure 10:
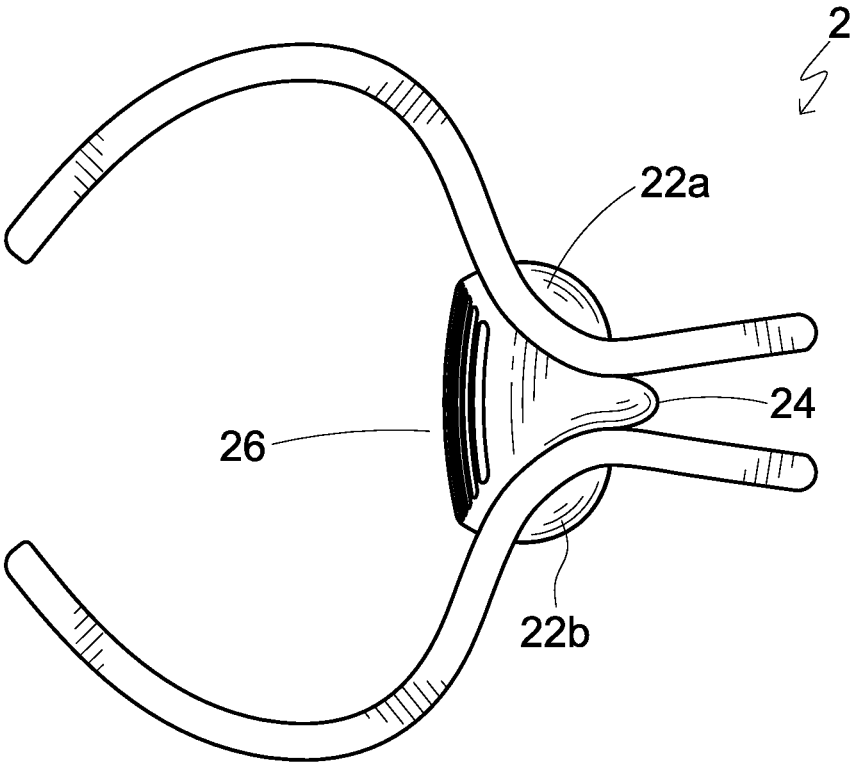
Figure 11:
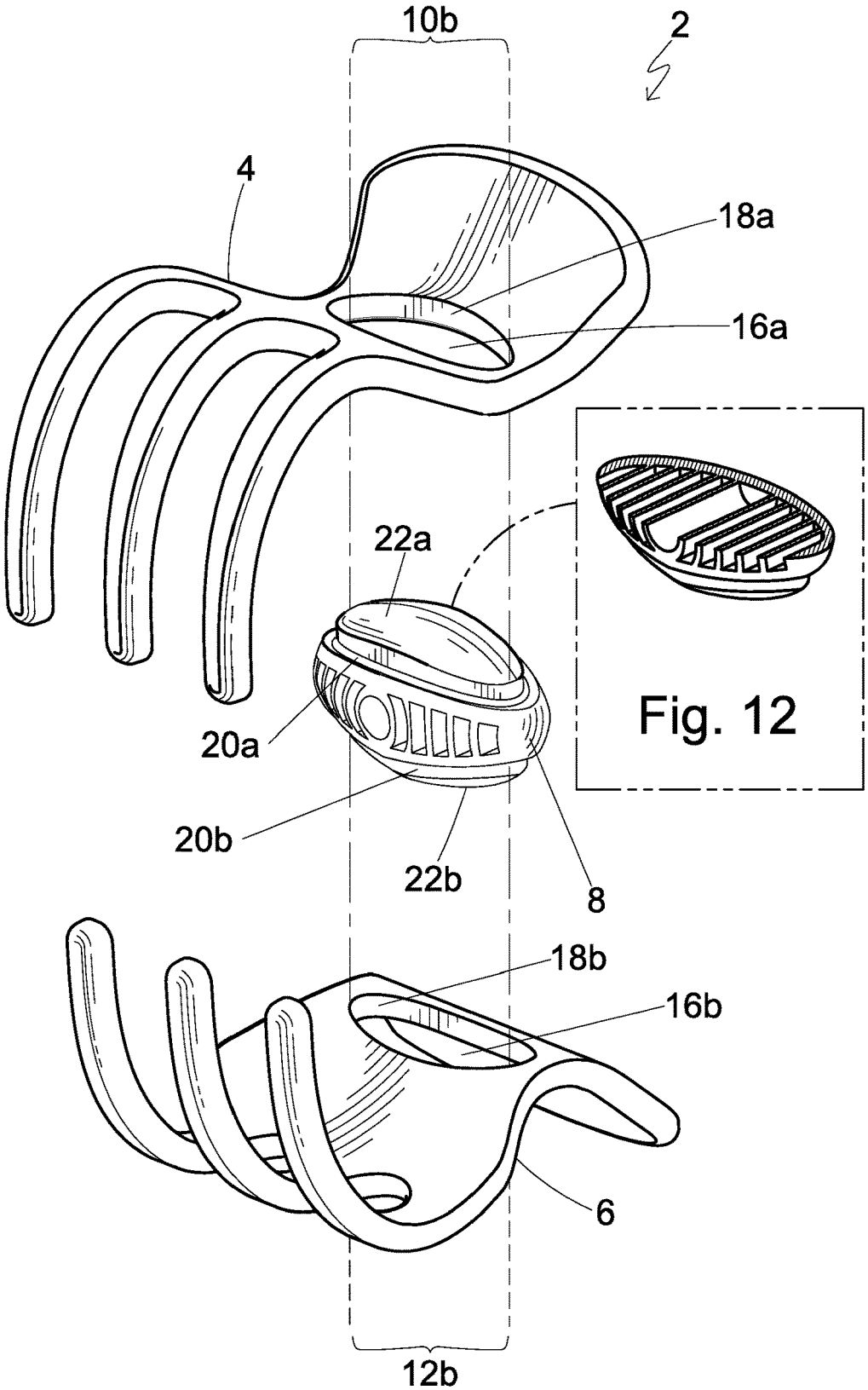
FIG. 11 is an exploded view of the hair fastener of FIG. 1.

In this embodiment, the elongate connector 8 defines a rearward surface 24 facing away the rear portions 10*a*, 12*a* and a forward surface 26 facing the front portions 10*c*, 12*c*, wherein the elongate block 8 is provided with a plurality of cut-out regions 28 at the forward surface 28 or at least visible from the forward surface whereby the elongate block 8 at the forward surface 26 resembles a gill structure. The gill structure weakens the density of the elongate block 8 at the forward surface thus allowing the elongate block 8 and to act as a hinge mechanism. The weakened elongate block 8 provides a differential on strength and density in the elongate block 8 allows the claw members 4, 6, during movement of the handles, to be spread apart more easily, and yet the resilience of the elongate block 8 still sufficiently allows the claw members 4, 6 to move together and close by default thus securing hair therebetween. FIGS. 9-11 illustrate the gill-structure of the connector 8 in a more detailed manner. In particular, there is a plurality of tunnel-like structures arranged and defined in the connector 8. The tunnel-like structures are defined by and between pairs of oppositely facing and generally parallel walls. In a closed or default configuration, the walls are in a relaxed state. Please see for example FIGS. 1-2, 5-6 and 11-12, and in particular FIG. 11. In an open or expanded configuration, the walls are in a stretched state. Please see for example FIGS. 9-10.

The hair fastener 2 as described above can be manufactured by producing the first claw member 4 and the second claw member 6 by way of a first injection molding, and then separately producing the connector 8 by way of a second, one-step, injection molding. After the claw members 4, 6 and the connector 8 have been made, they can be assembled by placing the connector 8 between the pair of cooperating claw members 4, 6 at the joint portions 10*b*, 12*b* thereof, with the grooves 20*a*, 20*b* secured at the complementary rims 18*a*, 18*b*. Then the connector 8 is to be fixedly connected to the rims 18*a*, 18*b* by way or heat sealing or by adhesives. Alternatively, the pair of claw members 4, 6 may be placed in a mould and the connector 8 may be formed in the mould thus simultaneously forming the connector 8 and connecting the connector 8 to the claw members 4, 6 in one step. Such methods of manufacture can significantly lower cost due to reduced number of manufacturing steps and not using metallic components.

Figure 5:
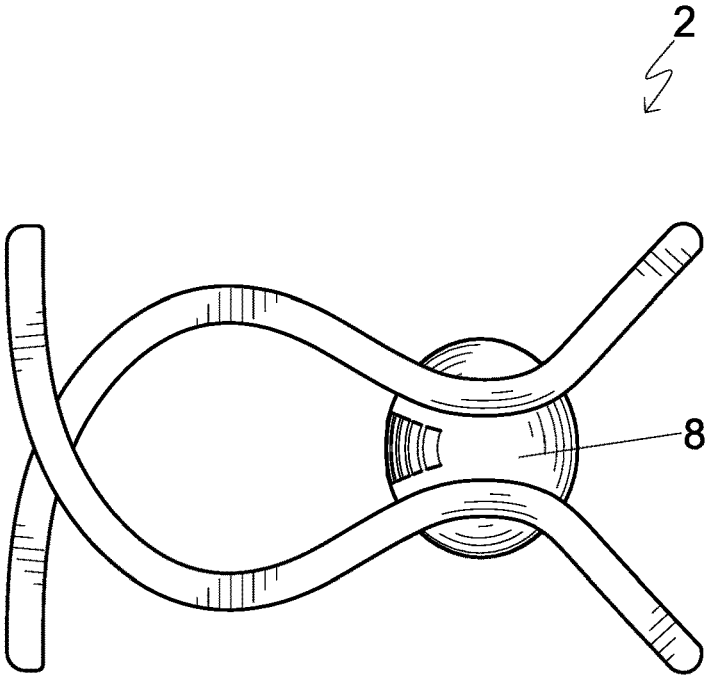
FIG. 5 and FIG. 6 are opposite side views of the hair fastener of FIG. 1.
Figure 6:
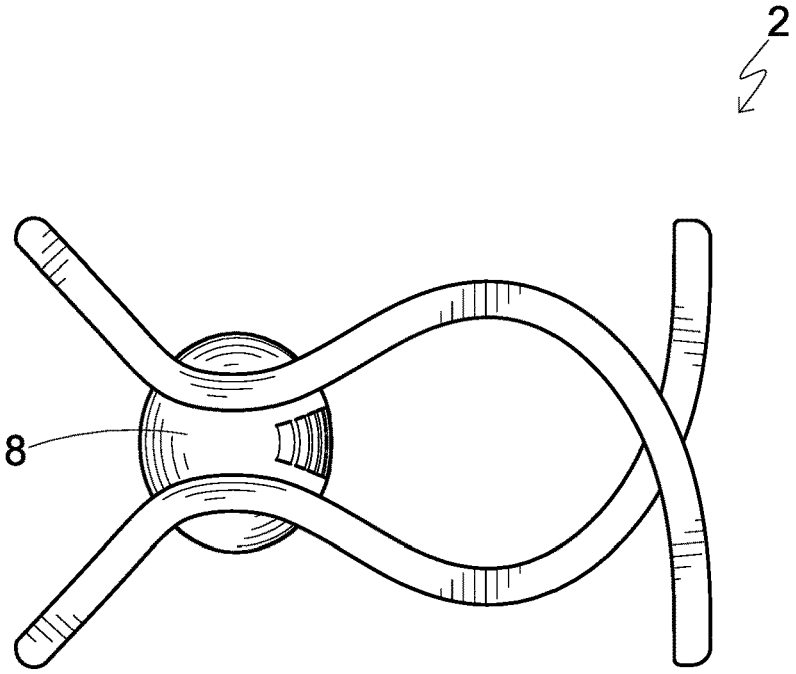
Figure 7:
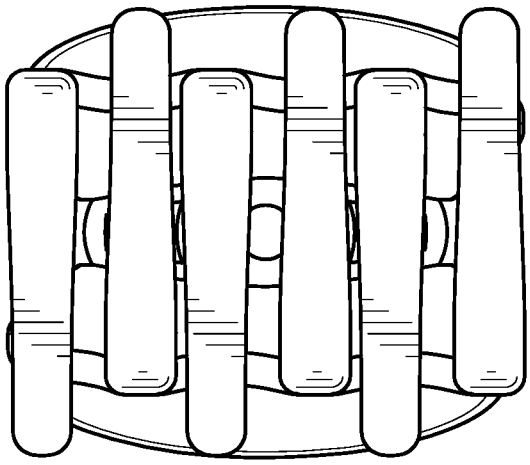
FIG. 7 and FIG. 8 are front and rear views of the hair fastener of FIG. 1.
Figure 8:
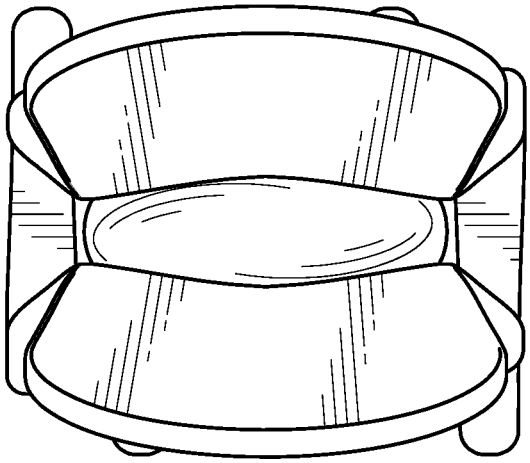

FIG. 5 and FIG. 6, for example, illustrate the hair fastener 2 in a closed or default configuration. Accordingly, the connector 8 is in an uncompressed or default configuration. FIG. 9 and FIG. 10 illustrate the hair fastener 2 in an open or expanded configuration. In use, the hair fastener 2 is opened by depressing or bringing the handles or the rear portions 10*a*, 12*a* together. As the rear portions 10*a*, 12*a* are brought together, a rear region of the connector 8 is compressed and squeezed while a front region of the connector 8 is stretched. Due to the gill structure of the connector 8, the front portion is weakened so as to allow the stretching thereof more easily during opening of the claw members 10*c*, 12*c*. When the handles are no longer depressed together, the resilience of the connector 8 pulls the claw members back together thus returning the hair fastener 2 into a default state thus securing hair positioned therebetween.

A second embodiment of a hair fastener 102 according to the present invention is depicted in FIGS. 13-20. The first and the second embodiments share common features which will not be discussed for reasons of brevity. The discussion below will focus on the differences.

Figure 13:
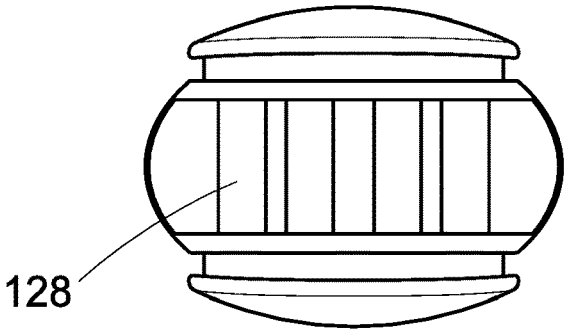
FIGS. 13 to FIG. 17 are different views showing a different connector for use in a second embodiment of a hair fastener according to the present invention.
Figure 14:
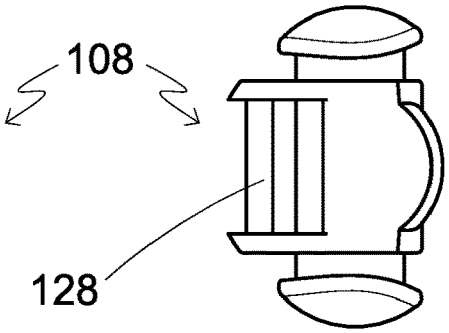
Figure 15:
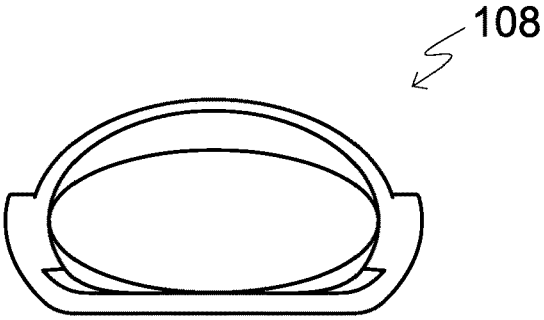
Figure 17:
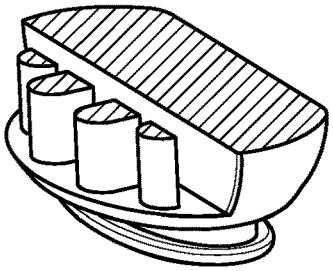
Figure 16:
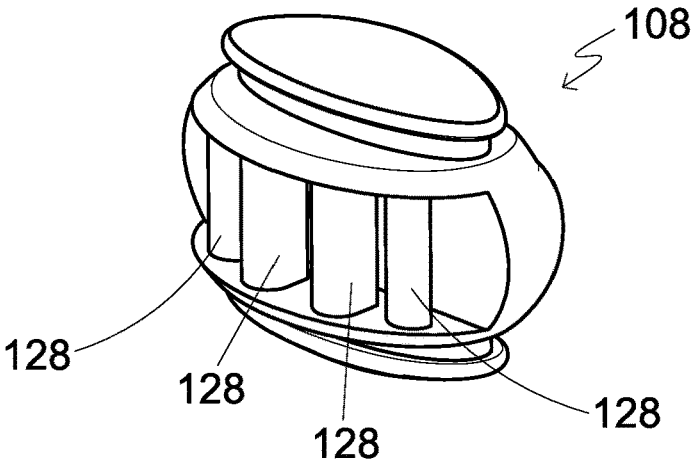

Similar to the hair fastener 2, the hair fastener 102 similar has a connector 108. Please see FIGS. 13-16. The connector 108 similarly is provided with a rear region 124 with a rearward surface facing away the hair fastener 102 and a forward region 126 facing front portions 110*c* and 112*c*. The forward surface 126 is however different in that instead of provided with cutout regions, tension cables 128 are provided. FIG. 13, FIG. 14 and FIG. 16 show a front view, a side view and a perspective view of the connector 108, respectively, demonstrating the profile of the tension cables 128. The tension cables 128 extend from opposite ends of the connector 108. A clearance is provided between the tension cables 128 and the rear region 124.

Figure 18:
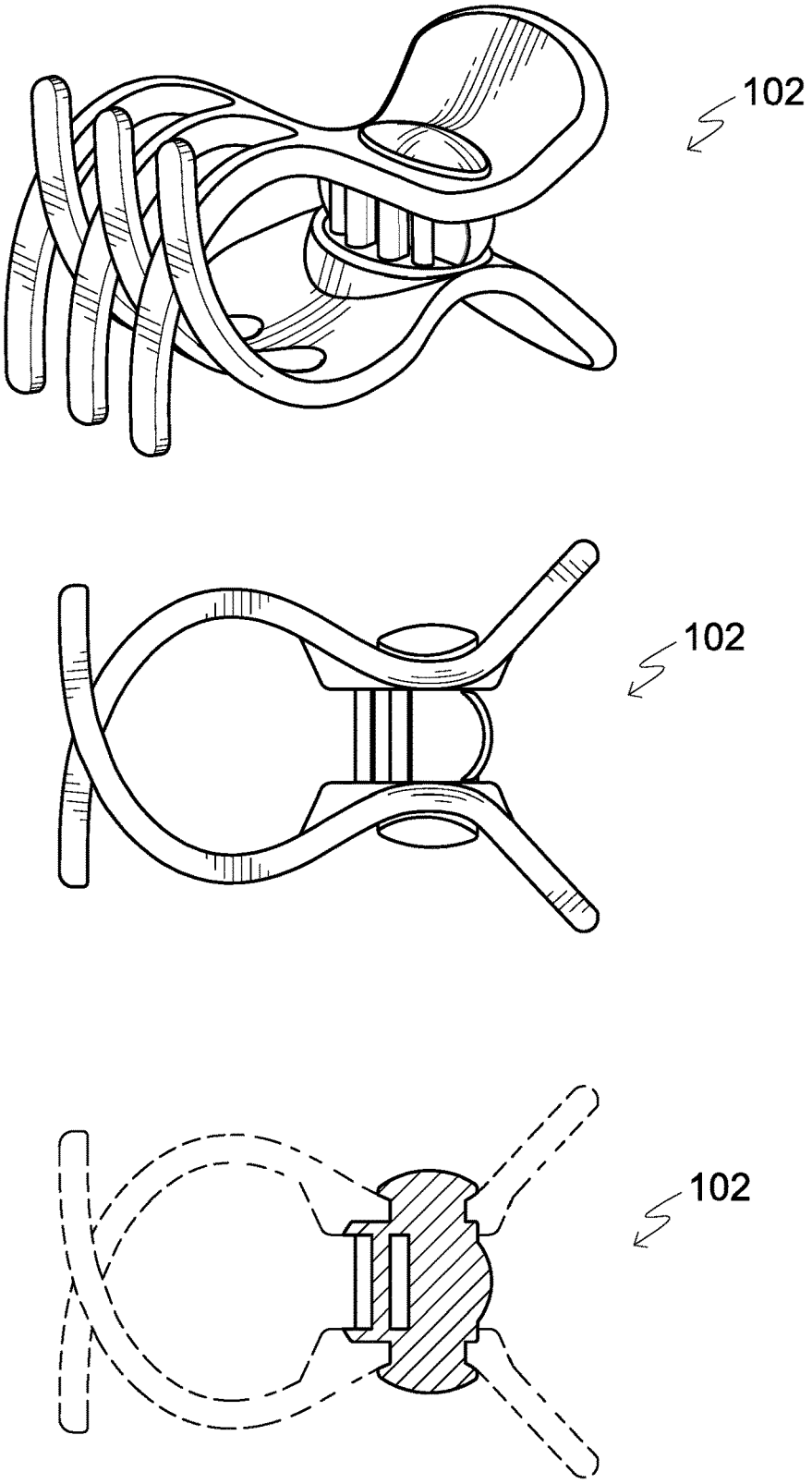
FIG. 18 is a schematic diagram showing of the second embodiment incorporated with the connector of FIGS. 13-17, the hair fastener assuming a closed configuration.

FIG. 18 depicts a perspective view, a side view and a schematic view showing the hair fastener 102 incorporated with the connector 108 assuming a default or closed configuration. In this configuration, the connector 108 is not under any pressure or strain and claw members are closed with fingers thereof arranged complementary of each other. In this default state, the tension cables 128 keep hair claw members close to each other. It can be envisaged that in such default state, in use a log of hair can be secured between the hair claw members.

Figure 20:
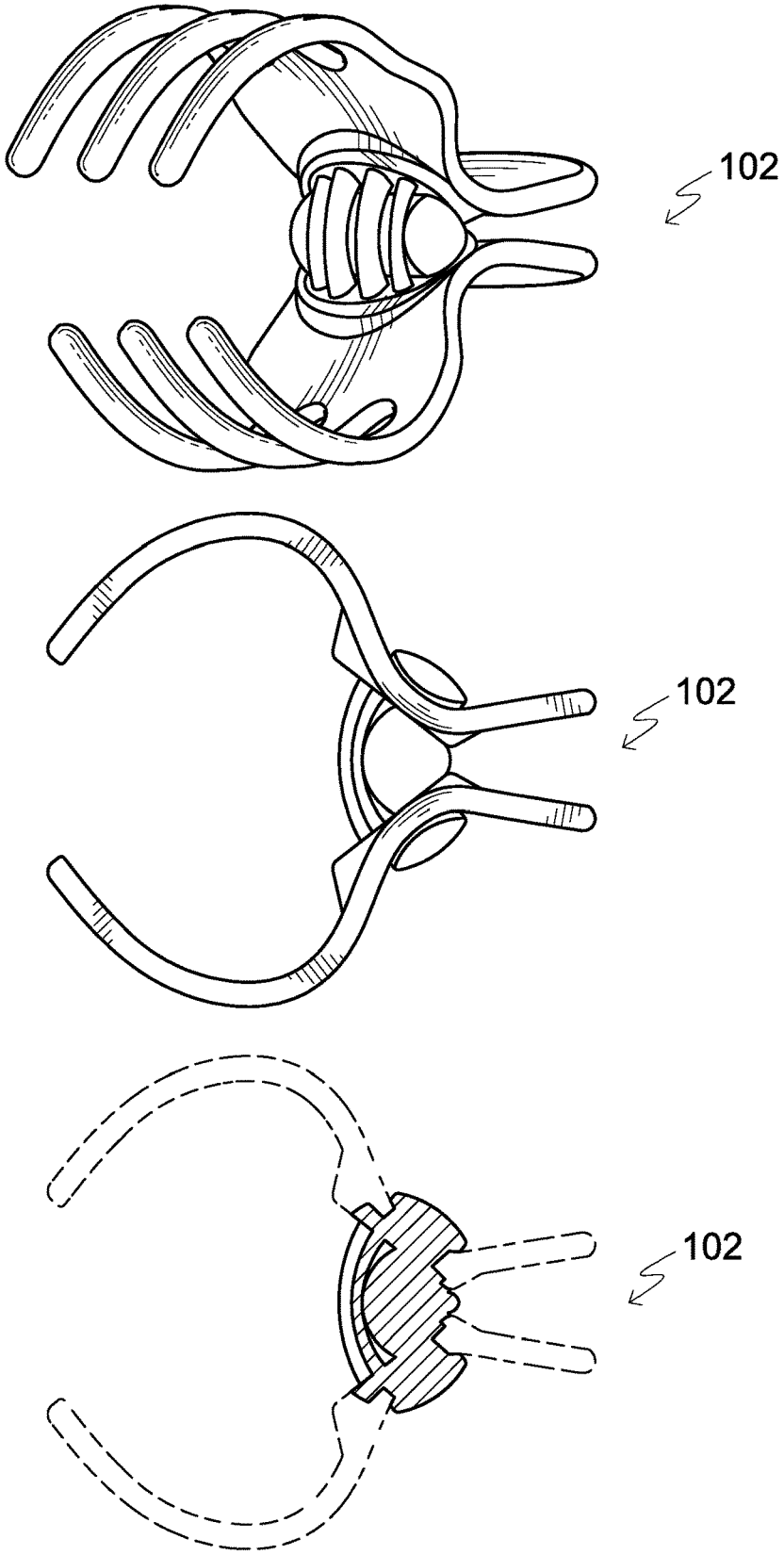
FIG. 20 is a schematic diagram showing of the hair fastener of FIG. 18, but assuming an open or expanded configuration.
Figure 21:
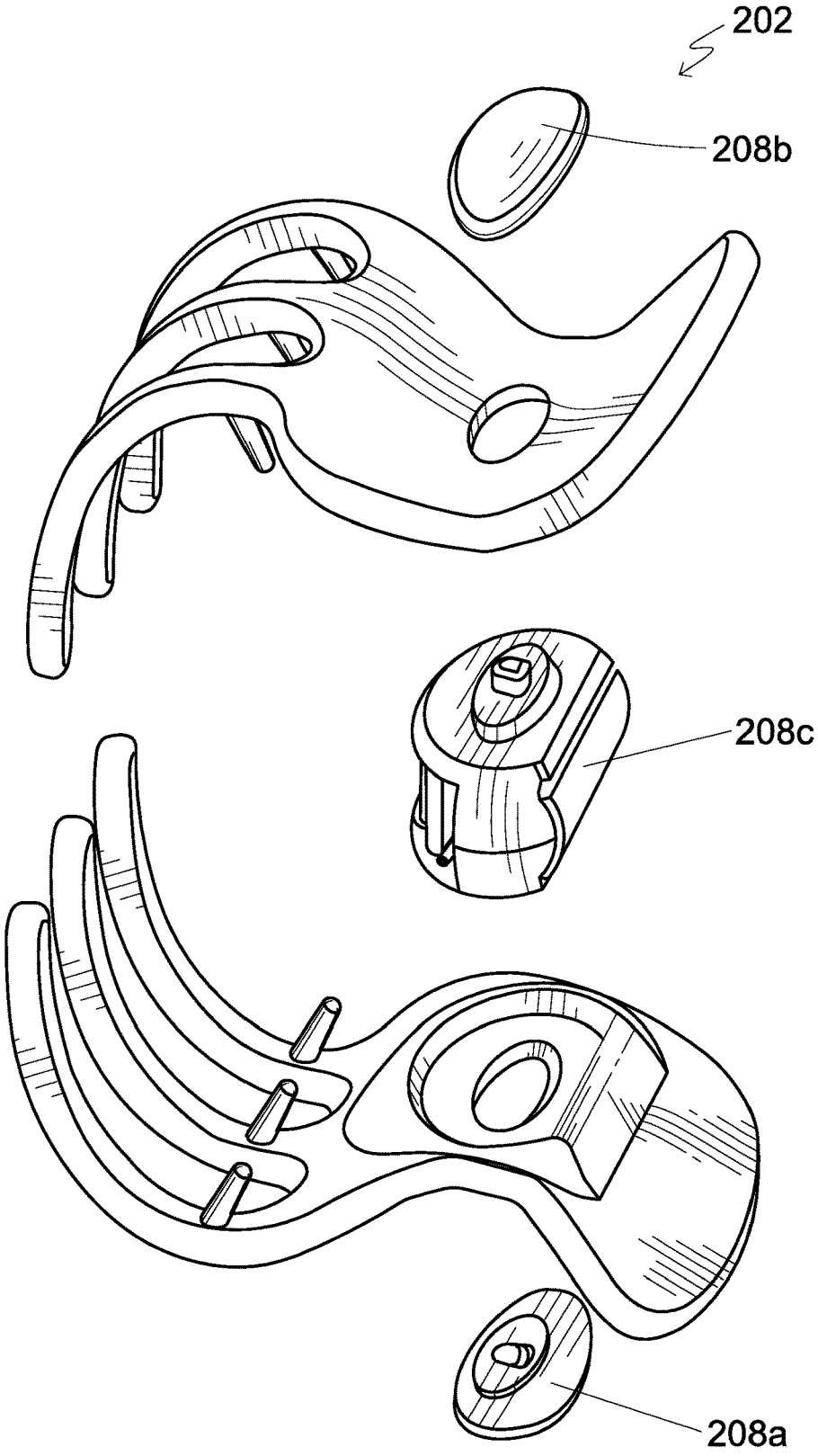
FIG. 21 is an exploded view of a third embodiment of a hair fastener according to the present invention.
Figure 22:
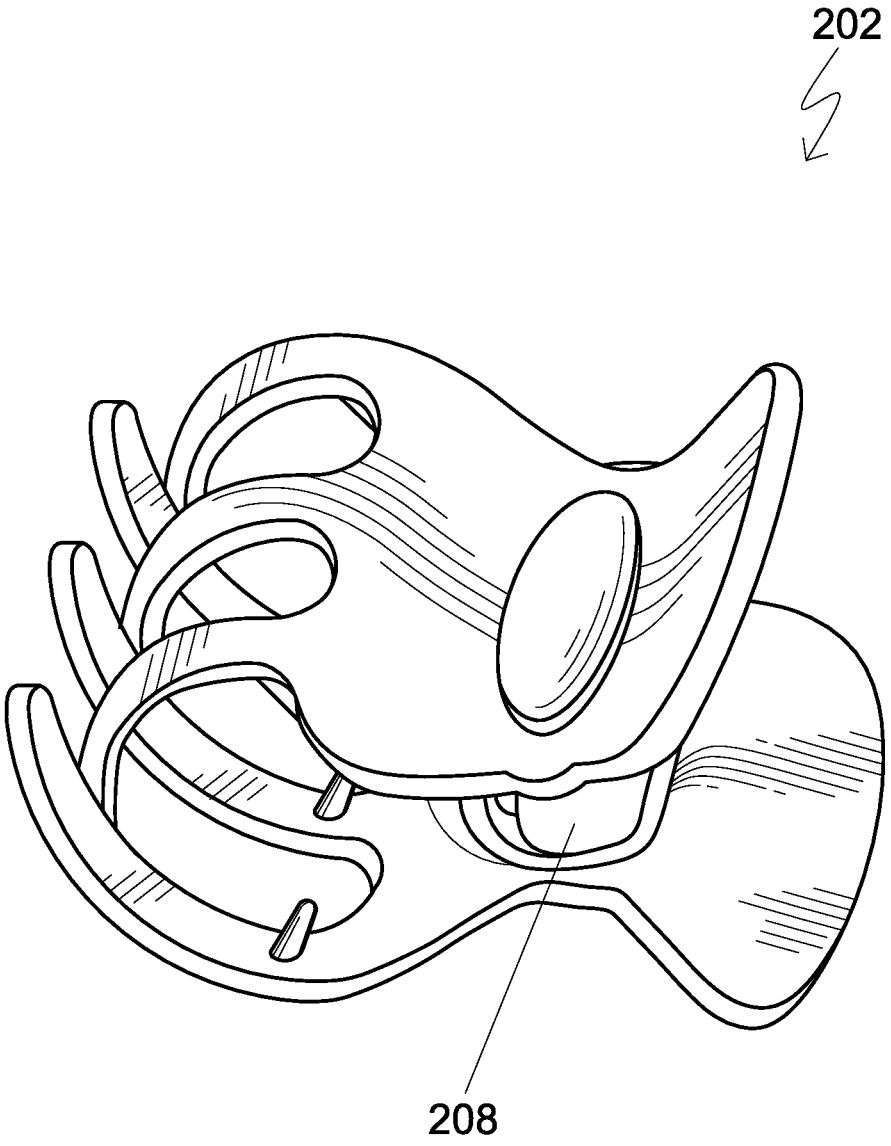
FIG. 22 is a perspective of the hair fastener of FIG. 21 but assuming a closed or default configuration.
Figure 23:
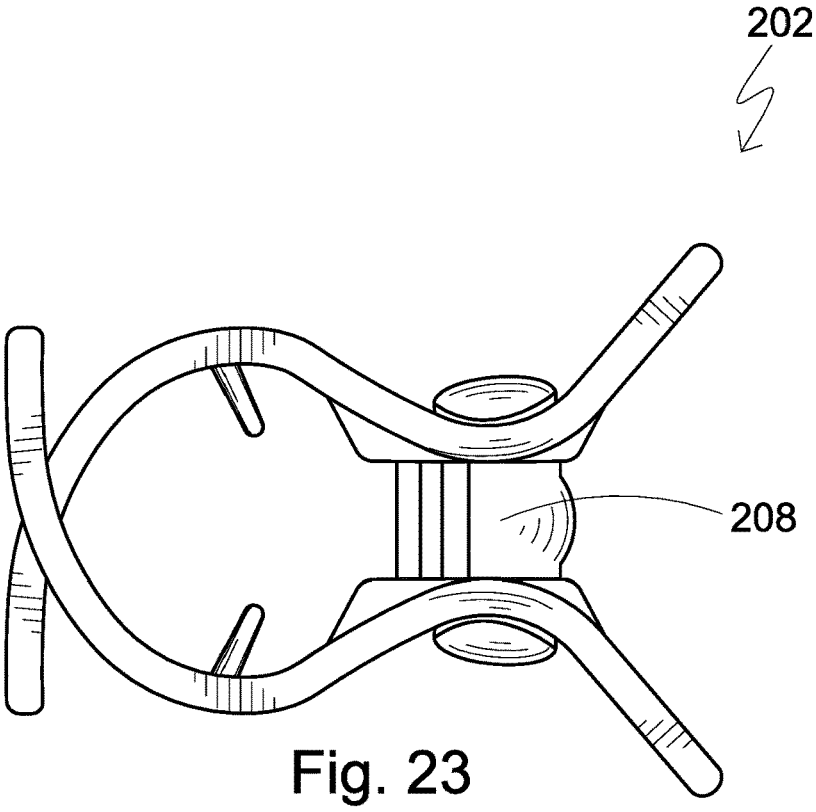
FIG. 23 is a side view of the hair faster of FIG. 21.
Figure 24:
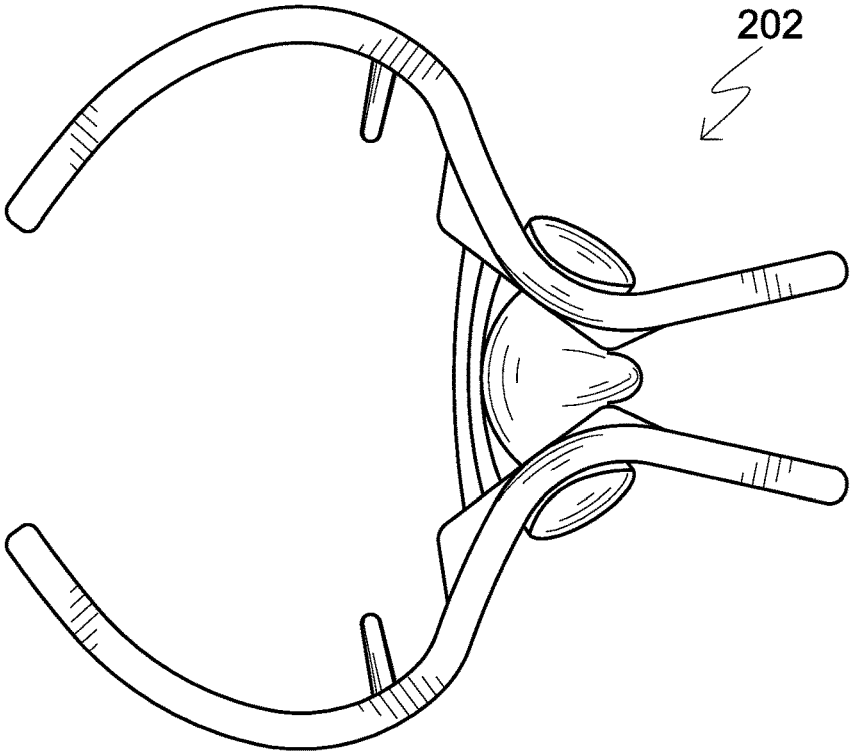
FIG. 24 is also a side view of the hair faster of FIG. 21 but assuming an open or expanded configuration.

FIG. 20 similarly depicts a perspective view, a side view and a schematic view showing the hair fastener 102 but assuming a fully open or expanded configuration. In this configuration, handles of the hair fasteners 102 are depressed and brought together, thus moving the hair claw members apart. It can be seen, and understood, that the tension cables 128 are stretched and elongated. In this open state, the tension cables 128 are under strain. It can be envisaged that in such open state, in use the claw members can be placed around or removed from a log of hair.

Figure 19:
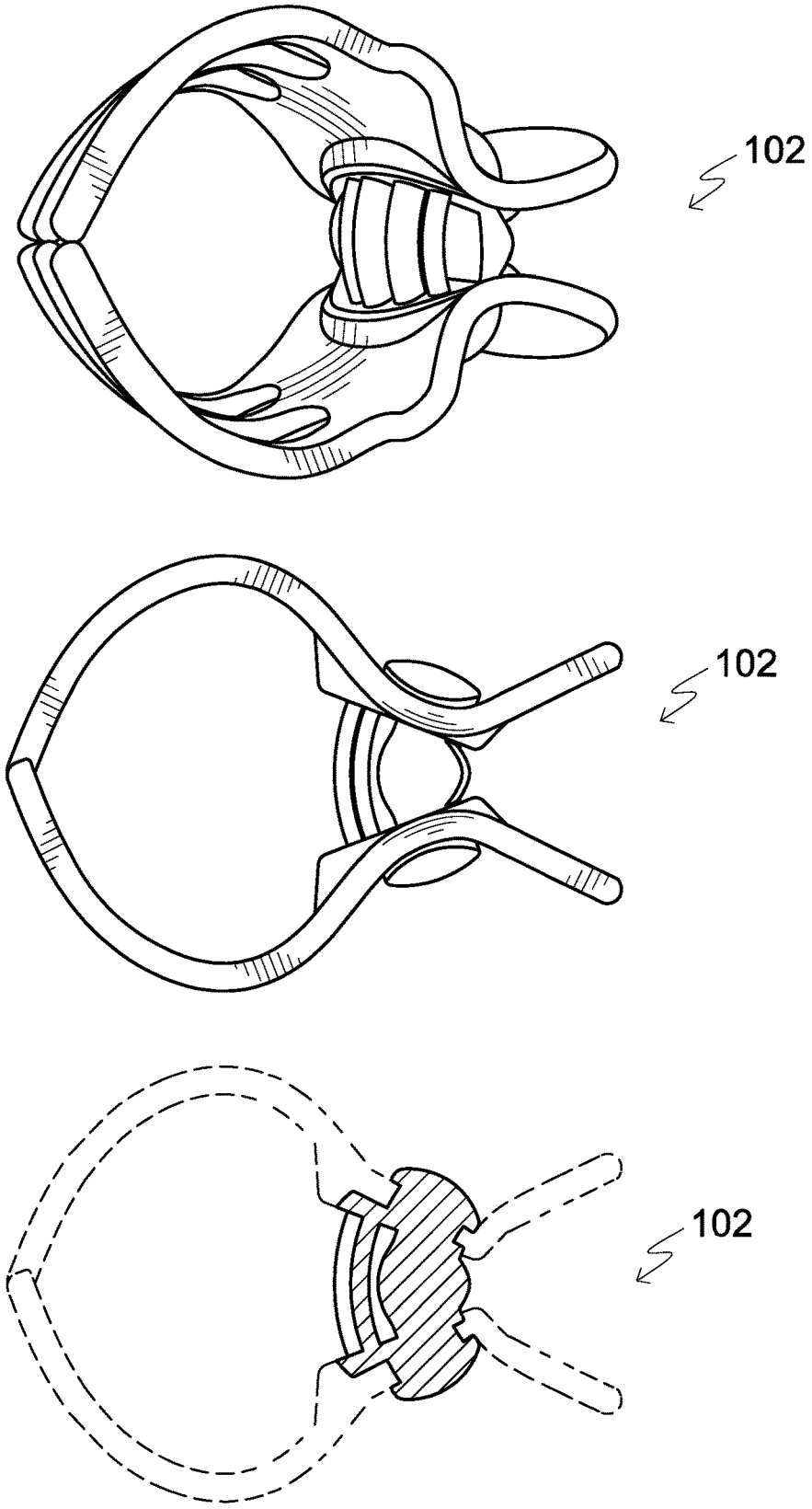
FIG. 19 is a schematic diagram showing of the hair fastener of FIG. 18, but assuming an a configuration between the closed configuration of FIG. 18 and the open configuration of FIG. 20.

FIG. 19 similarly depicts a perspective view, a side view and a schematic view showing the hair fastener 102 but assuming a configuration between the closed and open configurations. In this state, the tension cables 128 are semi-stretched and the hair claw members are still under the tension from the tension cables and biased towards each other.

In this embodiment, four such tension cables 128 are provided eventually on the front of the connector. The use of such tension cables are advantageous in a number of ways. For example, the biasing force from the tension cables can be modulated by changing the number or thickness of tension cables thus allowing more design freedom. For instance, a series of hair claws with different closing strength can be provided. Further, since the tension cables are distinct and separated from the rear region of the connector, the tension cables can operate independently and thus the closing or opening of the hair claw members can be effected more efficiently.

A third embodiment of a hair fastener 202 according to the present invention is depicted in FIGS. 21-24. The second and the third embodiments share common features which will not be discussed for reasons of brevity. The discussion below will focus on the differences.

The hair fastener 202 similarly provides a connector 208. However, instead of configured in a one-piece construction or made from a one-step injection molding manner, the connector 208 is made from a three-piece construction. Specifically, the connector is made of a top piece 208*b*, a bottom piece 208*a* and a middle piece 208*c* positioned between the top and bottom pieces. The top piece and the center piece together defines upper a circumferential groove and the bottom piece and the center piece together defining a lower circumferential groove. The top piece and the bottom piece are fixedly connected to the center piece thus sandwiching and securing the first and second claw members together at the center piece.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A hair fastener in the form of a hair claw comprising a first claw member, a second claw member and an elongate block, wherein:

each of the first and second claw members is provided with a front portion, a rear portion and a joint portion arranged in between, the rear portions of the first and second claw members acting as a pair of handles for controlling opening or closure of the hair fastener, the elongate block is positioned between the first and second claw members at the joint portions thus acting as a hinge at which the first and second claw members are pivotably and reciprocatingly movable with respect to each other, the elongate block is made of polymeric materials and provided with a front region and a rear region, the front region includes a plurality of tension cables arranged and spaced across the front region of the elongate block, and a clearance is provided between the tension cables and the rear region such that the tension cables and the rear region can operate independently of each other, each of the joint portions of the claw members is provided with an opening defining a rim, the elongate block is provided with an upper circumferential groove and a lower circumferential groove formed at the opposite ends thereof and the elongate block fixedly connects to both the first and second claw members, respectively, by adhesives or heat seals, with the grooves engaged to the rims, the elongate member is adapted to assume a first configuration in which as the handles are moved towards each other the rear region is compressed and squeezed and the tension cables are stretched, and a second configuration in which as the handles are released the tension cables pull the first and second claw members towards each other thus returning the hair fastener to the closure state.

2. A hair fastener as claimed in claim 1, wherein the elongate block include a center piece, a top piece and a bottom piece, with the top piece and the center piece together defining the upper circumferential groove and the bottom piece and the center piece together defining the lower circumferential groove, and wherein the top piece and the bottom piece are fixedly connected to the center piece thus sandwiching and securing the first and second claw members together at the center piece.

3. A hair fastener as claimed in claim 1, wherein the openings of the joint portions are generally of oval shape, the grooves are sized and shaped to complementarily engage with the rims and the elongate block is generally in the form of an oval-shaped connector.

4. A hair fastener as claimed in claim 1, wherein the first and second claw members are made of a material selected from the group consisting of ABS, PP, HIPS, GPPS, PE, Nylon, polycarbonate, K-resin, cellulose acetate, PVC, PET and PLA, and the polymeric materials of the elongate block are silicone.

5. A hair fastener as claimed in claim 1, comprising four said tension cables arranged and spaced evenly across the front region of the elongate block.

6. A hair fastener as claimed in claim 1, wherein the hair fastener or at least the hinge thereof is free of any metallic components.

* * * * *